US011686300B2

(12) United States Patent
Mochidzuki

(10) Patent No.: US 11,686,300 B2
(45) Date of Patent: Jun. 27, 2023

(54) CRYOPUMP AND REGENERATION METHOD OF CRYOPUMP

(71) Applicant: SUMITOMO HEAVY INDUSTRIES, LTD., Tokyo (JP)

(72) Inventor: Kenji Mochidzuki, Tokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 17/521,367

(22) Filed: Nov. 8, 2021

(65) Prior Publication Data

US 2022/0145871 A1 May 12, 2022

(30) Foreign Application Priority Data

Nov. 10, 2020 (JP) ..... 2020-187235

(51) Int. Cl.
*F04B 37/08* (2006.01)
*B08B 7/00* (2006.01)

(52) U.S. Cl.
CPC ..... *F04B 37/08* (2013.01); *B08B 7/005* (2013.01); *F04B 37/085* (2013.01)

(58) Field of Classification Search
CPC ..... F04B 37/08; F04B 37/085; B08B 7/005
See application file for complete search history.

(56) References Cited

U.S. PATENT DOCUMENTS 6,238,630 B1 * 5/2001 Iimura ..... C02F 1/725 422/186.3
9,869,020 B2 1/2018 Malinen et al.
2002/0184896 A1 * 12/2002 Buonpane ..... F04B 37/08 62/55.5
2009/0073686 A1 * 3/2009 Lai ..... F21V 3/10 362/231
2018/0348509 A1 * 12/2018 Carpenter ..... B08B 7/005

FOREIGN PATENT DOCUMENTS

JP H10-073077 A 3/1998
JP 6021276 B2 10/2016
JP 6218921 B2 10/2017
WO WO-2014/033359 A1 3/2014

* cited by examiner

*Primary Examiner* — Lionel Nouketcha
(74) *Attorney, Agent, or Firm* — Michael Best & Friedrich LLP

(57) ABSTRACT

A cryopump includes at least one cryopanel including a photocatalyst layer on a surface thereof, and an excitation light source that is disposed so as to irradiate the photocatalyst layer with excitation light that activates the photocatalyst layer.

14 Claims, 3 Drawing Sheets

CRYOPUMP AND REGENERATION METHOD OF CRYOPUMP

RELATED APPLICATIONS

The content of Japanese Patent Application No. 2020-187235, on the basis of which priority benefits are claimed in an accompanying application data sheet, is in its entirety incorporated herein by reference.

BACKGROUND

Technical Field

Certain embodiments of the present invention relate to a cryopump and a regeneration method of a cryopump.

Description of Related Art

Cryopumps are vacuum pumps that capture gas molecules through condensation and adsorption on a cryopanel cooled to a cryogenic temperature and exhaust the gas molecules. The cryopumps are generally used in order to realize a clean vacuum environment required for semiconductor circuit manufacturing processes or the like. Since the cryopumps are so-called gas accumulating type vacuum pumps, regeneration in which the captured gas is periodically discharged to the outside is required.

SUMMARY

According to an embodiment of the present invention, a cryopump includes at least one cryopanel including a photocatalyst layer on a surface thereof; and an excitation light source that is disposed so as to irradiate the photocatalyst layer with excitation light that activates the photocatalyst layer.

According to another embodiment of the present invention, a cryopump includes at least one cryopanel including a photocatalyst layer on a surface thereof; and a cryopump container that has a window for taking in excitation light for activating the photocatalyst layer and that accommodates the cryopanel.

According to still another embodiment of the present invention, a regeneration method of a cryopump includes irradiating a photocatalyst layer on a cryopanel with excitation light that activates the photocatalyst layer; and removing an organic substance adhering to the photocatalyst layer from the cryopanel by decomposing the organic substance under irradiation with the excitation light.

In addition, any combinations of the above components and those obtained by substituting the components or expressions of the present invention with each other between methods, devices, systems, and the like are also effective as embodiments of the present invention.

DETAILED DESCRIPTION

Various chemical substances flow into a cryopump as gases from a semiconductor manufacturing apparatus during a vacuum exhaust operation, and such gases include, for example, vapors of organic substances derived from photoresists applied to wafers, organic solvents used for various surface treatments onto wafers, or the like. The gases may condense and adhere on a cryopanel and contaminate the cryopanel. Once such organic deposits adhere to the cryopanel, the organic deposits are not easily discharged from a cryopump by the existing cryopump regeneration method and are gradually accumulated on the cryopanel. When the deposits are present between the cryopanel and an ice layer such as water or argon that deposits on the cryopanel, the adhesion of the ice layer to the cryopanel is reduced, and the ice layer is likely to crack or peel off on the cryopanel. The cracking or peeling-off of the ice layer causes a gap between the ice layer and the cryopanel and hinders good thermal contact therebetween. As a result, cooling of the ice layer by the cryopanel may be weakened, and a rise in the temperature of the ice layer and an increase in the vapor pressure in the cryopump may be brought about. Accordingly, the exhaust performance of the cryopump may eventually deteriorate.

It is desirable to provide a cryopump capable of removing an organic substance adhering to a cryopanel.

Hereinafter, embodiments for carrying out the present invention will be described in detail with reference to the drawings. In the description and drawings, the same or equivalent components, members, and processing will be designated by the same reference symbols, and redundant description thereof will be appropriately omitted. The scales and shapes of the respective parts illustrated in the figures are set for convenience in order to facilitate the description, and should not be interpreted as limiting unless otherwise specified. The embodiments are merely examples and do not limit the scope of the present invention. All the features and combinations to be described in the embodiments are not necessarily essential to the invention.

Figure 1:
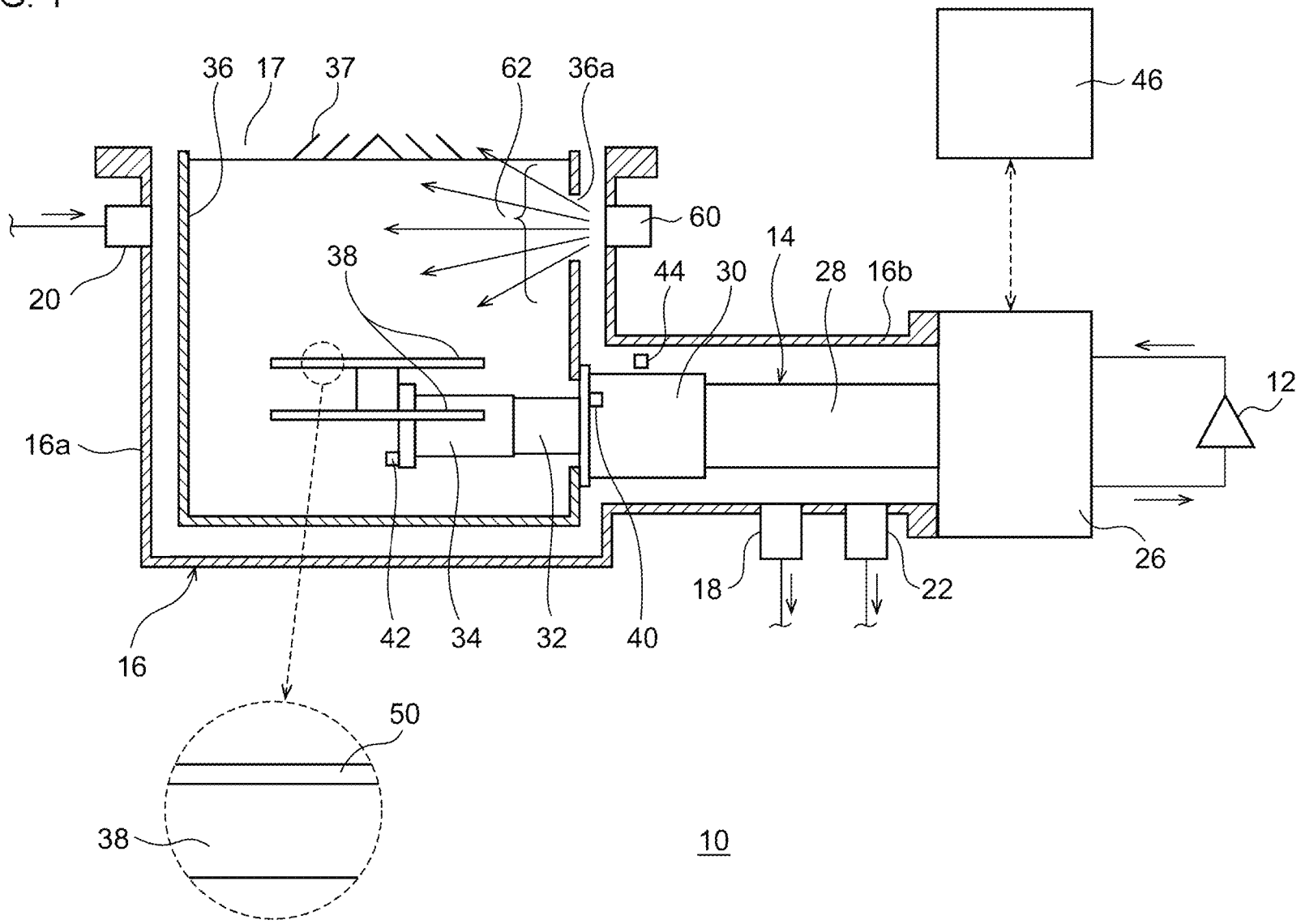
FIG. 1 schematically shows a cryopump according to an embodiment.

FIG. 1 schematically shows a cryopump 10 according to the embodiment. The cryopump 10 is attached to, for example, a vacuum chamber of an ion implanter, a sputtering device, a vapor deposition device, or other vacuum process devices, and is used in order to increase the degree of vacuum inside a vacuum chamber to a level required for a desired vacuum process. For example, a high degree of vacuum of approximately $10^{-5}$ Pa to $10^{-8}$ Pa is realized in the vacuum chamber.

The cryopump 10 includes a compressor 12, a cryocooler 14, and a cryopump container 16. The cryopump container 16 includes a cryopump intake port 17. Additionally, the cryopump 10 includes a rough valve 18, a purge valve 20, a vent valve 22, and a switching control valve 24, which are installed in the cryopump container 16. The cryopump 10 includes a radiation shield 36 and at least one cryopanel 38 that are accommodated in the cryopump container 16.

The compressor 12 is configured to recover a refrigerant gas from the cryocooler 14, to pressurize the recovered refrigerant gas, and to supply the refrigerant gas to the cryocooler 14 again. The cryocooler 14 is also referred to as an expander or a cold head and constitutes a cryocooler together with the compressor 12. A thermodynamic cycle, through which chill is generated, is configured by performing the circulation of the refrigerant gas between the compressor 12 and the cryocooler 14 with an appropriate combination of pressure fluctuations and volume fluctuations of the refrigerant gas in the cryocooler 14, so that the cryocooler 14 can provide cryogenic temperature cooling. Although the refrigerant gas is typically a helium gas, other appropriate gases may be used. In order to facilitate understanding, a direction in which the refrigerant gas flows is shown with an arrow in FIG. 1. Although the cryocooler is, for example, a two-stage Gifford-McMahon (GM) cryocooler, the cryocooler may be a pulse tube cryocooler, a Stirling cryocooler, or other types of cryocoolers.

The cryocooler 14 includes a room temperature portion 26, a first cylinder 28, a first cooling stage 30, a second cylinder 32, and a second cooling stage 34. The cryocooler 14 is configured to cool the first cooling stage 30 to a first cooling temperature and to cool the second cooling stage 34 to a second cooling temperature. The second cooling temperature is lower than the first cooling temperature. For example, the first cooling stage 30 is cooled to approximately 65K to 120K, preferably 80K to 100K, and the second cooling stage 34 is cooled to approximately 10K to 20K. The first cooling stage 30 and the second cooling stage 34 are also referred to as a high-temperature cooling stage and a low-temperature cooling stage, respectively.

The first cylinder 28 connects the first cooling stage 30 to the room temperature portion 26, and thereby, the first cooling stage 30 is structurally supported by the room temperature portion 26. The second cylinder 32 connects the second cooling stage 34 to the first cooling stage 30, and thereby, the second cooling stage 34 is structurally supported by the first cooling stage 30. The first cylinder 28 and the second cylinder 32 extend coaxially, and the room temperature portion 26, the first cylinder 28, the first cooling stage 30, the second cylinder 32, and the second cooling stage 34 are linearly arranged in a line in this order.

In a case where the cryocooler 14 is a two-stage GM cryocooler, a first displacer and a second displacer (not shown) are reciprocally disposed inside the first cylinder 28 and the second cylinder 32, respectively. A first regenerator and a second regenerator (not shown) are incorporated in the first displacer and the second displacer, respectively. Additionally, the room temperature portion 26 includes a drive mechanism (not shown) such as a motor for reciprocating the first displacer and the second displacer. The drive mechanism includes a flow path switching mechanism that switches between flow paths for a working gas (for example, helium) to periodically repeat supply and discharge of the working gas to and from the inside of the cryocooler 14.

The cryopump container 16 includes a container body 16*a* and a cryocooler accommodating tube 16*b*. The cryopump container 16 is a vacuum chamber that is designed to maintain vacuum during a vacuum exhaust operation of the cryopump 10 and to withstand a pressure in the ambient environment (for example, the atmospheric pressure). The container body 16*a* has a tubular shape of which one end is provided with the cryopump intake port 17 and the other end is closed. The radiation shield 36 is accommodated in the container body 16*a*, and the cryopanel 38 is accommodated in the radiation shield 36 together with the second cooling stage 34. The cryocooler accommodating tube 16*b* has one end coupled to the container body 16*a* and the other end fixed to the room temperature portion 26 of the cryocooler 14. In the cryocooler accommodating tube 16*b*, the cryocooler 14 is inserted, and the first cylinder 28 is accommodated.

In the embodiment, the cryopump 10 is a so-called horizontal cryopump in which the cryocooler 14 is provided at a side portion of the container body 16*a*. A cryocooler insertion port is provided in the side portion of the container body 16*a*, and the cryocooler accommodating tube 16*b* is coupled to the side portion of the container body 16*a* at the cryocooler insertion port. Similarly, adjacent to the cryocooler insertion port of the container body 16*a*, a hole through which the cryocooler 14 passes is provided also in a side portion of the radiation shield 36. The second cylinder 32 and the second cooling stage 34 of the cryocooler 14 are inserted into the radiation shield 36 through the holes, and the radiation shield 36 is thermally coupled to the first cooling stage 30 around the holes in the side portions.

The cryopump can be installed in various postures on the site of use. As an example, the cryopump 10 can be installed in a horizontal posture shown in the drawing, that is, a posture in which the cryopump intake port 17 faces upward. In this case, a bottom portion of the container body 16*a* is located below the cryopump intake port 17, and the cryocooler 14 extends in a horizontal direction.

In order to provide a cryogenic temperature surface for protecting the cryopanel 38 from radiant heat from the outside of the cryopump 10 or the cryopump container 16, the radiation shield 36 is thermally coupled to the first cooling stage 30 and is cooled to the first cooling temperature. The radiation shield 36 has, for example, a tubular shape that surrounds the cryopanel 38 and the second cooling stage 34. An end portion of the radiation shield 36 on a cryopump intake port 17 side is opened, a gas that enters through the cryopump intake port 17 from the outside of the cryopump 10 can be received in the radiation shield 36. An end portion of the radiation shield 36 opposite to the cryopump intake port 17 may be closed, may include an opening, or may be opened. There is a gap between the radiation shield 36 and the cryopanel 38, and the radiation shield 36 is not in contact with the cryopanel 38. The radiation shield 36 is also not in contact with the cryopump container 16.

An inlet cryopanel 37 fixed to an open end of the radiation shield 36 may be provided at the cryopump intake port 17. The inlet cryopanel 37 is cooled to the same temperature as the radiation shield 36 and can condense a so-called type 1 gas (a gas that condenses at a relatively high temperature, such as steam) on a surface thereof. The inlet cryopanel 37 is, for example, a louver or baffle, but may be, for example, a circular or other shaped plate or member disposed to occupy a part of the cryopump intake port 17.

In order to provide a cryogenic temperature surface that condenses a type 2 gas (for example, a gas that condenses at a relatively low temperature, such as argon and nitrogen), the cryopanel 38 is thermally coupled to the second cooling stage 34 and is cooled to the second cooling temperature. The cryopanel 38 may have, for example, a plate shape or umbrella shape, and may be disposed such that an upper surface thereof faces the cryopump intake port 17. As shown, a plurality of the cryopanels 38 may be provided, and the cryopanels 38 may be arranged from the cryopump intake port 17 toward the bottom portion of the radiation shield 36. Additionally, in order to adsorb a type 3 gas (for example, a non-condensable gas, such as hydrogen), for example, activated carbon or another adsorbent is disposed on at least a part of a surface (for example, a surface opposite to the cryopump intake port 17) of the cryopanel 38. A gas that enters the radiation shield 36 from the outside of the cryopump 10 through the cryopump intake port 17 is captured on the cryopanel 38 through condensation or adsorption.

The radiation shield 36 and the inlet cryopanel 37 cooled to the first cooling temperature may be collectively referred to as a high-temperature cryopanel. Since the cryopanel 38 is cooled to the second cooling temperature lower than the first cooling temperature, the cryopanel 38 can also be referred to as a low-temperature cryopanel. Since various known configurations can be appropriately adopted as forms that can be taken, such as the disposition and shape of the radiation shield 36 or the cryopanel 38, a description thereof will not be made herein in detail.

The cryopanel 38 has a photocatalyst layer 50 on at least a part of the surface thereof. The photocatalyst layer 50 may be, for example, a coating containing particles of a photocatalyst material. The disposition of the photocatalyst layer 50 is not particularly limited. As shown, the photocatalyst layer 50 may be provided on the low-temperature cryopanel, for example, at least apart of the upper surface (a surface on the cryopump intake port 17 side) of the cryopanel 38 disposed closest to the cryopump intake port 17. The photocatalyst layer 50 may be formed on at least a part of a lower surface of the uppermost cryopanel 38 or may be formed on at least a part of the surface of another cryopanel 38.

In a case where the adsorbent is disposed on at least a part of the surface of the cryopanel 38 to form an adsorption region as described above, the photocatalyst layer 50 may be disposed on the cryopanel 38 while avoiding the adsorption region. That is, the photocatalyst layer 50 may be formed on at least a part of a region excluding the adsorption region on the cryopanel 38. Typically, the adsorbent is made to adhere to the cryopanel 38 using an adhesive. By not providing the photocatalyst layer 50 in the adsorption region, it is possible to prevent the photocatalyst layer 50 from acting on the adhesive and deteriorating the adhesive.

Additionally, the photocatalyst layer 50 may be formed on another part cooled to the second cooling temperature, for example, at least a part of an outer surface of the second cooling stage 34 of the cryocooler 14. The photocatalyst layer 50 may be formed on at least a part of the outer surface of the second cylinder 32.

The photocatalyst layer 50 may be provided on the high-temperature cryopanel, for example, may be formed on at least a part of the surface of the inlet cryopanel 37. The photocatalyst layer 50 may be formed on at least a part of the surface (for example, an inner surface) of the radiation shield 36. As necessary, the photocatalyst layer 50 may be formed on at least parts of outer surfaces of the first cooling stage 30 and the first cylinder 28 of the cryocooler 14. The photocatalyst layer 50 may be formed on at least a part of an inner surface of the cryopump container 16.

The photocatalyst layer 50 may contain an ultraviolet light-responsive photocatalyst material that exhibits a photocatalytic action under ultraviolet light irradiation, for example, titanium oxide.

However, in recent years, a visible light-responsive photocatalyst material capable of exhibiting a photocatalytic action under visible light irradiation has been found. Thus, instead of the ultraviolet light-responsive photocatalyst material, the photocatalyst layer 50 may contain the visible light-responsive photocatalyst material. As the visible light-responsive photocatalyst material, for example, iron-based compound-modified titanium oxide, copper-based compound-modified titanium oxide, copper-based compound-modified tungsten oxide, and the like are known.

Additionally, the cryopump 10 includes an excitation light source 60 disposed so as to irradiate the photocatalyst layer 50 with excitation light 62 that activates the photocatalyst layer 50. The excitation light source 60 is installed in the cryopump container 16 so as to irradiate the inside of the cryopump container 16 with the excitation light 62. For example, the excitation light source 60 may be installed in the container body 16*a* of the cryopump container 16 so as to irradiate a space between the cryopump intake port 17 and the cryopanel 38 with the excitation light 62. The radiation shield 36 may be formed with an opening portion 36*a* for passing the excitation light 62 incident into the cryopump container 16 from the excitation light source 60. As long as the photocatalyst layer 50 is irradiated with the excitation light 62, the disposition of the excitation light source 60 is not particularly limited. A plurality of the excitation light sources 60 may be provided.

In a case where the photocatalyst layer 50 contains the visible light-responsive photocatalyst material, the excitation light source 60 is configured to emit light including a visible light wavelength range, which activates the visible light-responsive photocatalyst material as the excitation light 62. In a case where the photocatalyst layer 50 contains the ultraviolet light-responsive photocatalyst material, the excitation light source 60 is configured to emit ultraviolet light that activates the ultraviolet light-responsive photocatalyst material as the excitation light 62.

In a case where the excitation light source 60 emits the ultraviolet light, there is a risk of causing deterioration in the adhesive, which makes the adsorbent adhere to the cryopanel 38, for a long period of time. The visible light excitation light source 60 can reduce this risk and is easy to handle.

The excitation light source 60 may be configured to emit infrared light. For example, the excitation light source 60 may include a broadband light source (for example, a halogen lamp or the like) that emits the infrared light together with the excitation light 62. Alternatively, the excitation light source 60 may include a first light-emitting element that emits the excitation light 62 and a second light-emitting element that emits the infrared light, and the light-emitting elements may be, for example, LEDs. In this way, the excitation light source 60 can use the infrared light to heat an object to be irradiated such as the cryopanel 38 during the regeneration of the cryopump 10.

The cryopump 10 includes a first temperature sensor 40 for measuring the temperature of the first cooling stage 30 and a second temperature sensor 42 for measuring the temperature of the second cooling stage 34. The first temperature sensor 40 is attached to the first cooling stage 30. The second temperature sensor 42 is attached to the second cooling stage 34. The first temperature sensor 40 can measure the temperature of the radiation shield 36 and output a first measured temperature signal indicating the measured temperature of the radiation shield 36. The second temperature sensor 42 can measure the temperature of the cryopanel 38 and output a second measured temperature signal indicating the measured temperature of the cryopanel 38. Additionally, a pressure sensor 44 is provided inside the cryopump container 16. The pressure sensor 44 is installed in, for example, the cryocooler accommodating tube 16*b*, measures the internal pressure of the cryopump container 16, and can output a measured pressure signal indicating the measured pressure.

Additionally, the cryopump 10 includes a controller 46 that controls the cryopump 10. The controller 46 may be provided integrally with the cryopump 10 or may be configured as a control device separate from the cryopump 10.

The controller 46 may be connected to the first temperature sensor 40 to receive a first measured temperature signal from the first temperature sensor 40 and be connected to the second temperature sensor 42 to receive a second measured temperature signal from the second temperature sensor 42. The controller 46 may be connected to the pressure sensor 44 to receive a measured pressure signal from the pressure sensor 44.

The controller 46 may control the cryocooler 14 on the basis of the cooling temperature of the radiation shield 36 and/or the cryopanel 38 in the vacuum exhaust operation of the cryopump 10. Additionally, in a regeneration operation of the cryopump 10, the controller 46 may control the cryocooler 14, the rough valve 18, the purge valve 20, the vent valve 22, and the excitation light source 60 on the basis of a pressure in the cryopump container 16 (or as necessary, on the basis of the temperature of the cryopanel 38 and a pressure in the cryopump container 16).

The rough valve 18 is installed at the cryopump container 16, for example, the cryocooler accommodating tube 16*b*. The rough valve 18 is connected to a rough pump (not shown) installed outside the cryopump 10. The rough pump is a vacuum pump for evacuating the cryopump 10 to the operation starting pressure. The cryopump container 16 communicates with the rough pump when the rough valve 18 is opened through the control of the controller 46, and the cryopump container 16 is cut off from the rough pump when the rough valve 18 is closed. By opening the rough valve 18 and operating the rough pump, the cryopump 10 can be decompressed.

The purge valve 20 is installed at the cryopump container 16, for example, the container body 16*a*. The purge valve 20 is connected to a purge gas supply device (not shown) installed outside the cryopump 10. Purge gas is supplied to the cryopump container 16 when the purge valve 20 is opened through the control of the controller 46, and the supply of the purge gas to the cryopump container 16 is cut off when the purge valve 20 is closed. The purge gas may be, for example, a nitrogen gas or other dry gases. The temperature of the purge gas may be adjusted to, for example, the room temperature, or may be heated to a temperature higher than the room temperature. By opening the purge valve 20 and introducing the purge gas into the cryopump container 16, the cryopump 10 can be pressurized. Additionally, the temperature of the cryopump 10 can be raised from the cryogenic temperature to the room temperature or a temperature higher than the room temperature.

The vent valve 22 is installed at the cryopump container 16, for example, the cryocooler accommodating tube 16*b*. The vent valve 22 is provided in order to discharge a fluid from the inside of the cryopump 10 to the outside thereof. The vent valve 22 may be connected to a storage tank (not shown) outside the cryopump 10, which receives the fluid to be discharged. Alternatively, in a case where the fluid to be discharged is harmless, the vent valve 22 may be configured to release the fluid to be discharged, to the ambient environment. The fluid to be discharged from the vent valve 22 is basically a gas but may be a liquid or a mixture of a gas and a liquid.

The vent valve 22 is opened and closed in accordance with a command signal input from the controller 46. The vent valve 22 is opened by the controller 46 when a fluid is released from the cryopump container 16 such as during regeneration. When the fluid is not to be released, the vent valve 22 is closed by the controller 46. The vent valve 22 may be, for example, a normally closed type control valve. In addition, the vent valve 22 is configured to function as a so-called safety valve mechanically opened when a predetermined differential pressure is applied. For that reason, the vent valve 22 is mechanically opened without requiring control when the inside of the cryopump has become high-pressure for some reason. Accordingly, the high pressure therein can be released.

The internal configuration of the controller 46 is realized by elements or circuits including a CPU and memories of a computer as a hardware configuration and is realized by computer programs as a software configuration, but is appropriately shown in the drawings as functional blocks realized through the cooperation therebetween. It is clear for those skilled in the art that the functional blocks can be realized in various forms by the combination of hardware and software.

For example, the controller 46 can be mounted by the combination of a processor (hardware) such as a central processing unit (CPU) and a microcomputer and software programs executed by the processor (hardware). The software programs may be computer programs for causing the controller 46 to execute the regeneration of the cryopump 10.

Figure 2:
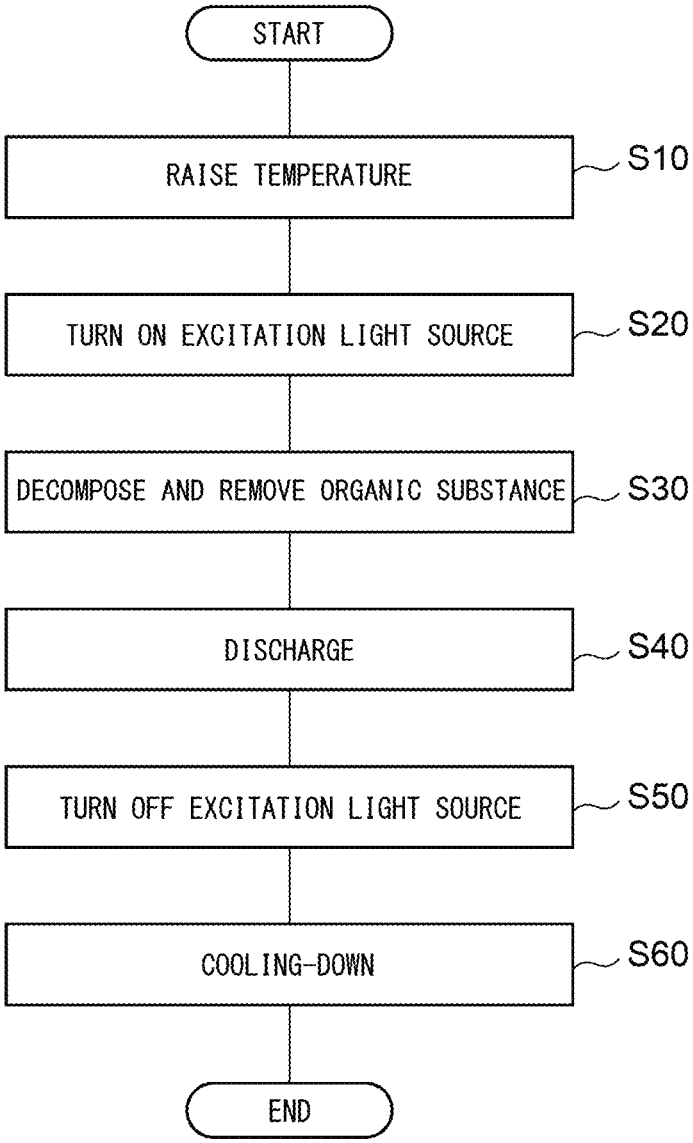
FIG. 2 is a flowchart showing a regeneration method of the cryopump according to the embodiment.

FIG. 2 is a flowchart showing the regeneration method of the cryopump 10 according to the embodiment. A regeneration sequence of the cryopump 10 according to the embodiment also includes decomposing and removing an organic deposit (S20, S30, S50) using the photocatalyst layer 50 and the excitation light 62 in addition to including a temperature raising process (S10), a discharging process (S40), and a cooling-down process (S60) similar to the existing cryopump regeneration. The regeneration sequence is executed by the controller 46.

In the temperature raising process (S10), the temperature of the cryopump 10 is raised from a cryogenic temperature to the room temperature or a regeneration temperature higher than the room temperature by the purge gas supplied to the cryopump container 16 through the purge valve 20 or other heating means (for example, about 290K to about 300K). As for the temperature rise of the cryopump 10, for example, a reverse temperature rise by the cryocooler 14 may be used, or in a case where an electric heater is installed in the cryopump 10, this electric heater may be used. In this way, the gas captured in the cryopanel 38 is vaporized again.

The excitation light source 60 is turned on (S20). The excitation light 62 is emitted from the excitation light source 60 and irradiates the photocatalyst layer 50 on the cryopanel 38 or on other parts of the cryopump 10 (for example, the inlet cryopanel 37 and the cryopanel 38). Accordingly, the photocatalyst layer 50 can exhibit the photocatalytic action.

Additionally, in a case where the excitation light source 60 can emit the infrared light, a cryogenic surface such as the cryopanel 38 can be heated by the irradiation with the infrared light. In the heating of the cryocooler 14 by the reverse temperature rise, a part where a heat transfer distance from the cryocooler 14 is long (for example, a terminal portion of the cryopanel 38, the inlet cryopanel 37, or the like) is less likely to be warmed than a part closer to the cryocooler 14. However, this can be complemented by the heating with the infrared light irradiation. Additionally, in the heating with an electric heater, there is a risk that a heater may overheat in a case where the thermal contact between the heater and an object to be heated is insufficient. However, it is considered that such a risk is small in the heating with the infrared light irradiation. Accordingly, the heating with the infrared light irradiation may be more useful than other heating means.

The excitation light source 60 may be turned on at the same time as the start of the temperature raising process, during the temperature raising process, or after the end of the temperature raising process. Ina case where the excitation light source 60 is used as one of the heating means, in order to shorten the temperature rising time, it is preferable that the excitation light source 60 is turned on at the same time as the start of the temperature raising process or during the temperature raising process, and is used in combination with the heating means.

The organic substance adhering to the photocatalyst layer 50 is decomposed under the irradiation with the excitation light 62 and thereby removed from the cryopanel 38 (S30). The organic deposit flows into the cryopump container 16 from a vacuum chamber of a vacuum process device to which the cryopump 10 is attached together with other exhausted gas (for example, water, argon, or the like) and are deposited on the cryopanel 38. For example, the organic deposit is derived from a photoresist applied to a wafer or organic chemicals used in various surface treatments onto the wafer. Since such an organic deposit has little or no volatility at the above-described regeneration temperature, the organic deposit cannot be removed from the cryopanel 38 simply by raising the temperature to the regeneration temperature.

The organic substance is decomposed into carbon dioxide and water by the photocatalytic action of the photocatalyst layer 50 under the irradiation with the excitation light 62. Carbon dioxide and water can be discharged as gases from the cryopump container 16 through the vent valve 22 or the rough valve 18. When the photocatalyst layer 50 is provided, for example, at another part in the cryopump 10 such as the inlet cryopanel 37, the organic substance adhering to the photocatalyst layer 50 at this part is also decomposed and removed. The process of decomposing and removing the organic deposit may occur during both the temperature raising process and the discharging process as long as irradiation is performed with the excitation light 62.

In the discharging process (S40), gas is discharged from the cryopump container 16 to the outside through the vent valve 22 or the rough valve 18. In the discharging process, so-called rough and purge may be performed. The rough and purge means discharging, from the cryopump container 16, the gas (for example, the gas such as steam adsorbed on, for example, an adsorbent such as activated carbon on the cryopanel 38) remaining in the cryopump container 16 by alternately repeating the rough pumping of the cryopump container 16 through the rough valve 18 and the supply of the purge gas to the cryopump container 16 through purge valve 20.

Whether or not to complete the discharging process is determined depending on a pressure rise rate test. The pressure rise rate test is also referred to as a rate-of-rise (RoR) test. In the pressure rise rate test, the magnitude of the pressure rise from a reference pressure when the cryopump container 16 is maintained in vacuum and a predetermined time elapses is detected, and when the magnitude of the pressure rise is less than a threshold, the test is determined as being passed, and when the magnitude is equal to or more than the threshold, the test is determined as failing. In order to maintain the cryopump container 16 in a vacuum, all the valves provided in the cryopump 10 are closed.

The excitation light source 60 is turned off (S50). The excitation light source 60 may be turned off at any timing during the regeneration of the cryopump 10. In a case where the excitation light source 60 is used as one of the heating means, the excitation light source 60 is turned off before the cooling-down process is started so as not to hinder the cooling-down.

In the cooling-down process (S60), the cryopump 10 is cooled again from the regeneration temperature to the cryogenic temperature. In this way, the regeneration is completed, and the cryopump 10 can start the vacuum exhaust operation again.

As described at the beginning of the present specification, if the cryogenic surface such as the cryopanel 38 is contaminated with the organic deposit and the organic deposit is interposed between the cryogenic surface and an ice layer such as water or argon that condenses on the cryogenic surface, the adhesion of the ice layer to the cryogenic surface is likely to be reduced, and the ice layer is likely to crack or peel off. The cracking or peeling-off of the ice layer hinders a good thermal contact between the ice layer and the cryogenic surface, resulting in a rise in the temperature of the ice layer and an increase in the vapor pressure inside the cryopump container. Accordingly, the exhaust performance of the cryopump may eventually deteriorate. For example, in a vacuum process device to which a cryopump is attached, it is required to restore the temporarily reduced degree of vacuum to a target degree of vacuum within a desired time when a processed wafer and an unprocessed wafer are replaced with each other. However, in a case where the organic substance adhering to the cryogenic surface is not removed, the time required for the restoration of the degree of vacuum extends. In the worst case, the target degree of vacuum may not be restored.

In the related art, a contaminated cryogenic surface may need to be decomposed and cleaned from the cryopump during the maintenance of the cryopump. The cleaned cryopanel is reassembled and used in a case where the cryopanel is reusable. In a case where the cryopanel cannot be reused, the cryopanel is discarded and replaced with a new cryopanel. In any case, substantial effort and cost are taken for such maintenance.

In contrast, according to the embodiment, the cryopump 10 can irradiate the photocatalyst layer 50 provided on the surface of the low-temperature cryopanel (or high-temperature cryopanel) with the excitation light 62 from the excitation light source 60, thereby decomposing and removing the organic substance adhering to the cryopanel. Accordingly, the above problems are alleviated or eliminated. For example, it is possible to suppress the deterioration in the exhaust performance of the cryopump 10 due to the organic substance contamination.

Additionally, the organic deposit is harmful substances in many cases, and in a case where the organic deposit are discharged from the cryopump 10 as they are, the possibility that the organic substance re-adheres to the rough valve 18, the vent valve 22, and a discharge path downstream of the vent valve 22 and have an adverse effect is assumed. However, according to embodiments, since the organic deposit can be decomposed into water and carbon dioxide and detoxified, such risks can be alleviated or eliminated.

Figure 3:
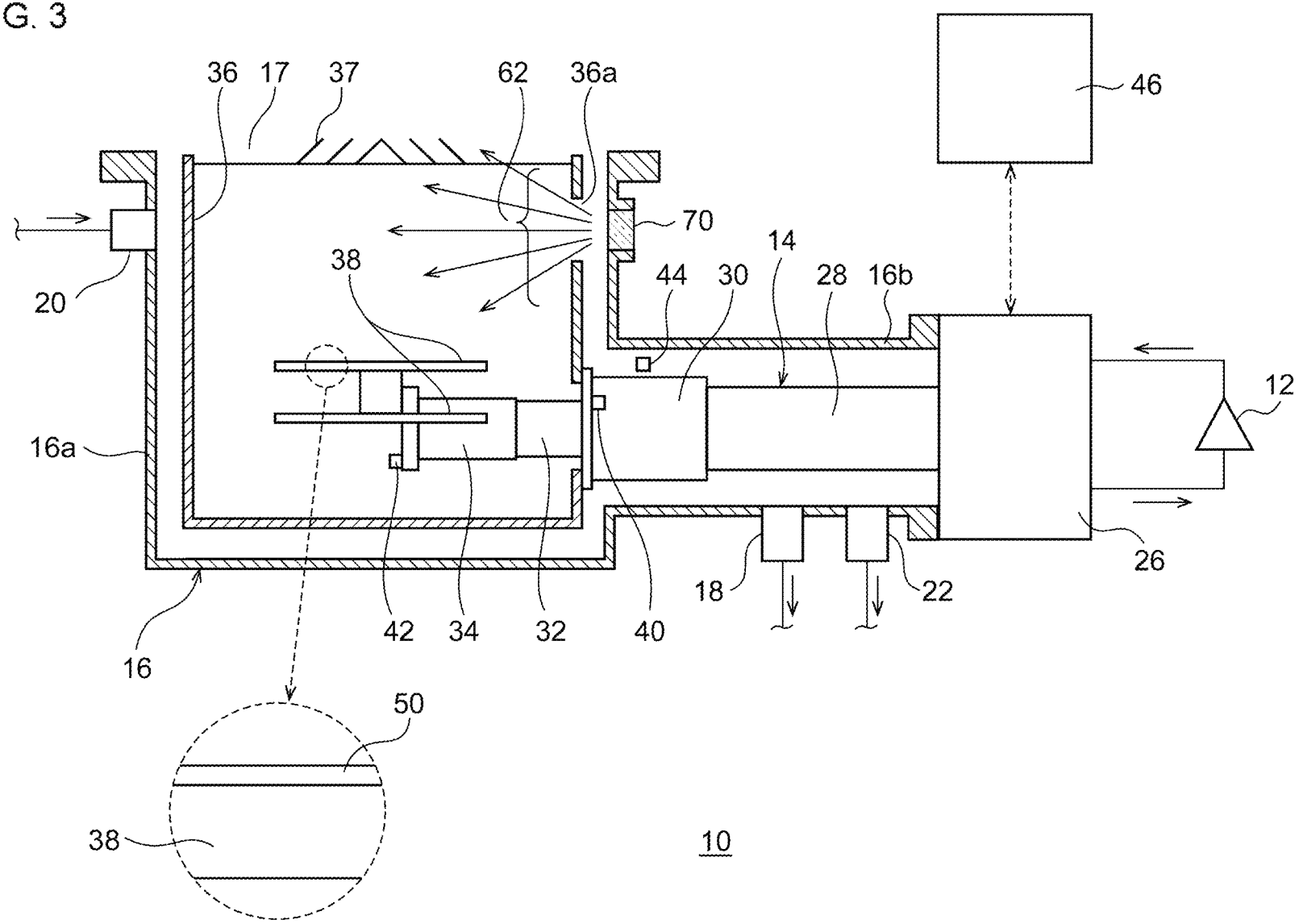
FIG. 3 schematically shows another example of the cryopump according to the embodiment.

FIG. 3 schematically shows another example of the cryopump 10 according to the embodiment. The cryopump 10 shown in FIG. 3 includes a window 70 instead of the excitation light source 60. The rest of the configuration is the same as that of the cryopump 10 shown in FIG. 1. The window 70 is provided in the cryopump container 16 in order to take in the excitation light 62, which activates the photocatalyst layer 50, from the outside. The window 70 may be, for example, a viewport provided on the container body 16*a*. Even in this way, by taking in the excitation light 62 from the window 70 and irradiating the photocatalyst layer 50 with the excitation light 62, the organic substance adhering to the low-temperature cryopanel (or the high-temperature cryopanel) can be decomposed and removed. In addition, in a certain embodiment, the cryopump 10 may include both the excitation light source 60 and the window 70.

The present invention has been described above on the basis of the embodiments. It should be understood by those skilled in the art that the present invention is not limited to the above embodiment, that various design changes are possible and various modification examples are possible, and that such modification examples are also within the scope of the present invention.

It should be understood that the invention is not limited to the above-described embodiment, but may be modified into various forms on the basis of the spirit of the invention. Additionally, the modifications are included in the scope of the invention.

What is claimed is:

1. A cryopump comprising:

a cryopump container defining a cryopump intake port;

a high-temperature cryopanel accommodated in the cryopump container and cooled to a first cooling temperature;

a low-temperature cryopanel surrounded with the high-temperature cryopanel and cooled to a second cooling temperature lower than the first cooling temperature;

a photocatalyst layer on a surface of the high-temperature cryopanel or a surface of the low-temperature cryopanel, and an excitation light source arranged to emit excitation light into a space that is between and defined by the cryopump intake port and the low-temperature cryopanel, wherein the excitation light source irradiates the photocatalyst layer with the excitation light.

2. The cryopump according to claim 1, wherein the photocatalyst layer contains a visible light-responsive photocatalyst material, and the excitation light source emits light including a visible light wavelength range, which activates the visible light-responsive photocatalyst material, as the excitation light.

3. The cryopump according to claim 1, wherein the excitation light source emits infrared light.

4. The cryopump according to claim 1, wherein the photocatalyst layer is provided on each of the high-temperature cryopanel and the low-temperature cryopanel.

5. The cryopump according to claim 1, wherein the high-temperature cryopanel comprises a radiation shield surrounding the low-temperature cryopanel and formed with an opening through which the excitation light passes from the excitation light source into the space.

6. The cryopump according to claim 1, wherein the high-temperature cryopanel comprises a radiation shield and the photocatalyst layer is on the radiation shield.

7. The cryopump according to claim 1, wherein the high-temperature cryopanel comprises an inlet cryopanel at the cryopump intake port and the photocatalyst layer is on the inlet cryopanel.

8. The cryopump according to claim 1, wherein the photocatalyst layer is on the surface of the low-temperature cryopanel.

9. A regeneration method of the cryopump according to claim 1, the regeneration method comprising:

starting a regeneration sequence of the cryopump;

irradiating the photocatalyst layer with the excitation light that activates the photocatalyst layer during the regeneration sequence; and removing an organic substance adhering to the photocatalyst layer on the surface of the high-temperature cryopanel or the surface of the low-temperature cryopanel by decomposing the organic substance under irradiation with the excitation light.

10. The regeneration method according to claim 9, further comprising:

turning on the excitation light source of the excitation light during the regeneration sequence.

11. The regeneration method according to claim 10, wherein the regeneration sequence includes a cooling-down process of the cryopump, wherein the regeneration method further comprises:

turning off the excitation light source before the cooling-down process.

12. The regeneration method according to claim 9, further comprising:

heating one of the high-temperature cryopanel or the low-temperature cryopanel with the excitation light.

13. A cryopump comprising:

a cryopump container defining a cryopump intake port;

a high-temperature cryopanel accommodated in the cryopump container and cooled to a first cooling temperature;

a low-temperature cryopanel surrounded with the high-temperature cryopanel and cooled to a second cooling temperature lower than the first cooling temperature;

a photocatalyst layer on at least one of a surface of the high-temperature cryopanel and a surface of the low-temperature cryopanel; and a window on the cryopump container arranged to allow excitation light into a space between and defined by the cryopump intake port and the low-temperature cryopanel.

14. The cryopump according to claim 13, wherein the high-temperature cryopanel comprises a radiation shield surrounding the low-temperature cryopanel, and wherein the radiation shield comprises an opening through which the excitation light passes from the window into the space.

* * * * *